US005714837A

United States Patent [19]

Zurn et al.

[11] Patent Number: 5,714,837

[45] Date of Patent: Feb. 3, 1998

[54] VERTICAL FIELD EMISSION DEVICES AND METHODS OF FABRICATION WITH APPLICATIONS TO FLAT PANEL DISPLAYS

[76] Inventors: Shayne Matthew Zurn, 11671 Oakview Ct., Champlin, Minn. 55316; Peter Joseph Schiller, 5840B Teakwood, Plymouth, Minn. 55442; Dennis Lee Polla, 9228 Loch Space, Lomond Ct., Brooklyn Park, Minn. 55443

[21] Appl. No.: 353,402

[22] Filed: Dec. 9, 1994

[51] Int. Cl.[6] ..... H01J 27/10; H01J 21/36

[52] U.S. Cl. ..... 313/495; 313/336; 313/309; 313/351; 313/310; 313/497; 313/496

[58] Field of Search ..... 313/309, 336, 313/351, 310, 495, 496, 497

[56] References Cited

U.S. PATENT DOCUMENTS

| | | | |
|---|---|---|---|
| 4,855,636 | 8/1989 | Busta et al. . | |
| 4,855,638 | 8/1989 | Busta . | |
| 5,349,217 | 9/1994 | Boysel . | |
| 5,457,335 | 10/1995 | Fleming et al. | 313/336 |

OTHER PUBLICATIONS

Q. Mei, "Process Characterization and Analysis of Sealed Vacuum Microelectronic Devices" J. Vac. Sci. Technol. B. vol. 12, No. 2, pp. 638–643, Mar./Apr. 1994.

Q. Mei, "Planar-Processed Tungsten and Polysilicon Vacuum Microelectronic Devices with Integral Cavity Sealing".

J. Vac. Sci. Technol. B. vol. 11, No. 2, pp. 493–496, Mar./Apr. 1993.

Bo Lee, "Development of Knife-Edge Field Emission Cathodes on (110) Silicon Wafers" Applied Surface Science vol. 67, pp. 66–72, 1993.

Heinz H. Busta, "Vacuum Microelectronics" J. Micromech. Microeng. vol. 2, pp. 43–74, 1992.

Ivor Brodie, "Vacuum Microelectronic Devices" Proceedings of the IEEE vol. 82, No. 7, pp. 1006–1034, Jul. 1994.

S. Zurn, "Sealed Vacuum Electronic Devices by Surface Micromachining," Proc. IEDM, pp. 205–208, 1991.

Roger T. Howe, "Surface Micromachining for Microsensors and Microactuators" J. Vac. Sci. Technol. B. vol. 6, No. 6, pp. 1809–1813, Nov./Dec. 1988.

*Primary Examiner*—Nimeshkumar Patel
*Attorney, Agent, or Firm*—Patterson & Keough, P.A.

[57] ABSTRACT

Vertical field emission devices are described with very small cathode to anode separations. Preferred cathodes have sharp edge emitters extending, outward perpendicular to the surface of the underlying substrate. These sharp edge emitters are produced within planar photolithography by coating sacrificial conformal walls and anisotropic etching. Microencapsulation is used to produce a sealed cavity at low pressure which includes the space between the anode and cathode. The field emission components can be adapted for the production of light emitting, field emission diodes. The individual cathode emitters can be integrated with solid state components on the substrate with each cathode being independently addressable. Arrays of closely packed light emitting, field emission diodes of the present invention are particularly suitable for use in displays. These displays would be useful for flat-panel computer displays and high definition television.

18 Claims, 6 Drawing Sheets

VERTICAL FIELD EMISSION DEVICES AND METHODS OF FABRICATION WITH APPLICATIONS TO FLAT PANEL DISPLAYS

TECHNICAL FIELD

The invention relates to microencapsulated, vertical field emission electronic components and methods for producing these components. The components of the invention include light emitting diodes produced with phosphors which become luminescent upon interaction with relatively low energy electrons. The invention further relates to the high density displays produced using planar photolithography processing methods with the ability to independently address individual diodes.

BACKGROUND OF THE INVENTION

With the advent of solid state microelectronic devices, vacuum tubes were rapidly replaced in most applications between 1955 and 1965. The two major disadvantages of vacuum tubes are the significant power waste resulting from the need to heat the cathode and the limits on the current density flowing from the cathode into the vacuum. Vacuum tubes have remained in use in certain applications, however, including microwave power tubes and cathode ray display tubes.

Vacuum microelectronic devices combine features of vacuum tubes and solid state devices. These devices have the potential of competing with solid state devices because they are capable of delivering high current densities without substantial power requirements. They also have the potential of replacing vacuum tubes in their remaining applications especially in producing flat-panel displays to compete with cathode ray display tubes.

Vacuum microelectronic devices have all of the major components of a vacuum tube, namely a cathode as a source of electrons, an anode and an effective vacuum between the cathode and the anode such that most of the electrons follow a collisionless trajectory between the electrodes. The distinguishing feature of the microelectronic devices are the incorporation of some solid state features into the component to allow very short distances between the electrodes. Therefore, vacuum microelectronic devices can be constructed with dimensions comparable to solid state devices.

In order to keep power requirements low, field emission electron sources are preferably used. In field emission electron sources, the cathode is not heated. An electric field is applied that is insufficient to overcome thermally the potential barrier at the cathode surface into the vacuum. The electric field is sufficient to lower the potential barrier enough to allow an ample numbers of electrons to quantum mechanically tunnel through the barrier to yield a suitable current in the vacuum. The small electrode to electrode distances require the use of only relatively small voltages while still producing sufficient fields.

Applications of vacuum microelectronic devices range from low current density applications to high current density applications and from single emitter applications to multi emitter applications. One application for single tip emitters is in the production of miniature electron microscopes. Other applications for single emitter devices include active elements for integrated circuits such as gated and ungated diodes, light emitting diodes, simple triode devices to replace transistor circuit elements or other multi-electrode devices. Arrays of field emitter elements can be used in electron impact ionization of gases or solid materials, for the production of microwaves in microwave tubes and in pressure sensors. A potentially very important use for arrays of vacuum microelectronic emitters are in the production of arrays of light emitting diodes for displays. Potential applications of vacuum microelectronic devices have been reviewed by H. H. Busta, Vacuum microelectronic - 1992, 2 J. Micromech. Microeng. 43 (1992), and I. Brodie and P. R. Schwoebel, Vacuum Microelectronic Devices, 82 Proc. IEEE, 1006 (1994).

Field emission vacuum microelectronic devices can be manufactured in either a lateral or vertical arrangement. In a lateral arrangement, the electron emissions travel essentially parallel to the substrate holding the cathode emitter. In a vertical arrangement, electron emission is perpendicular to the substrate.

Lateral devices are considered less difficult to fabricate. But lateral devices cannot be produced with a metal tip or edge in a high field contacting an insulating layer since electrons can tunnel into the conduction band of the insulator at lower fields than those required for tunneling into the vacuum. Most of the lateral devices produced so far have required gate currents larger than the emitter currents because of their unfavorable electron trajectories in comparison with vertical devices. Also, lateral devices have lower packing densities than comparable vertical devices. Perhaps the greatest limitation of the lateral devices are that they cannot easily be used in certain important applications including light emitting diodes which can be used in flat-panel displays for computers and for high definition television sets.

Most work on vertical emitters has focussed on cone shaped emitters known as Spindt emitters. Cone shapes have the advantages of being easy to produce and of having the large fields generated near the tip. Cones have the disadvantage that they are difficult to produce uniformly, they require control gates to initiate field emission and they use a large amount of lateral area. Edge emitters provide an alternative to cone shapes. Edge emitters have the potential for use in constructing much smaller components, but edge emitters have the disadvantage of typically being fragile. Edge emitters can have a large range in radius of curvature ranging from 90° for a ledge structure to, hypothetically, as small an angle as can be constructed given their fragility.

The vacuum between the cathode and the anode can be produced in one of two ways. In a macro encapsulation process, the devices are fabricated on a substrate with all the necessary inner connections. The entire substrate is encapsulated and a glass seal off tube is used to evacuate the device, after which the glass seal off tube is sealed. In a micro encapsulation process, small vacuum chambers are micro machined onto the substrate that house the emitters, collectors and gates using the "lost wax" process. Micro cavities are sealed by vacuum deposition of a suitable material. Vacuum pressures on the order of $1\times10^{-6}$ Torr can be achieved with this process. The pressures in the vacuum are determined by the pressures within the material deposition system. The micro encapsulation process eliminates the need to apply vacuum conditions external to the device.

The problem in the use of microencapsulation was that relatively large channels had to be vacuum sealed by sputter-deposited or evaporated materials. For example, see U.S. Pat. No. 4,855,636 to Busta et al. In practice, this results in a large fraction of nonfunctional devices. These problems have already been overcome for lateral devices, see Q. Mie et al., 11 J. Vac. Sci. Technol. B 493 (1993).

Arrays of cone emitters can be produced with small separations between the emitters. It is very difficult to produce these cone emitters at these close distances while making them individually addressable. This difficulty results because cone emitters are not produced using planar processing techniques which would allow more straightforward integration of the field emitters into the solid state portion of the component.

Flat panel displays have the potential of providing a huge market for vacuum microelectronic devices. In 1994, the market for flat panel displays was over $6 billion dollars. Second generation flat panel displays currently being marketed are active matrix liquid crystal displays (AMLCD's). AMLCD's have significant limitations. Their manufacturing process is complex and slow. Illumination in AMLCD's requires a fluorescent back light. The display only makes use of 3% to 10% of the available light. A serious drawback of AMLCD screens is that they can be difficult to see in bright sunlight or at large viewing angles. These visibility problems are of major concern in aircraft and automobile applications.

Field emission devices are an attractive alternative to AMLCD's. These vacuum microelectronic devices can offer lower manufacturing costs and reduce power consumption while providing increased brightness and improved viewing angles. Field emission devices produce their own light so all of the light generated is, in principle, available to be seen by the user. No power is consumed by pixels which are not illuminated. Field emission devices produce light using colored cathodo-luminescent phosphors which phosphoresce when they are struck by electrons from the cathode.

Light emitting, field emission diodes (LEFEDs) produce images in a similar way to conventional cathode ray tubes. In contrast with a cathode ray tube which uses a single electron gun, field emission devices have one or more electron sources for each pixel. Because CRT's use a single electron gun, they require a high vacuum necessary to achieve a long mean free path for the electrons as they travel to all parts of the screen.

Previous approaches to the production of flat panel displays using field emission devices have mostly made use of spindt cone cathodes. These field emission devices have relatively large cathode to anode distances. Electrons are emitted in an approximately 60° cone from the cathode to produce a relatively low resolution image at the anode. Structure can be put in place to focus the electron beam from the cathode but only at the expense of considerably more complicated production. Similarly, macroencapsulated field emission devices with edge emitters have a relatively large anode to cathode distance resulting in similar problems.

Displays based on the cone emitters have used an array of emitters for each pixel. Groups of emitters may correspond to a single color within the pixel. The use of multiple emitters in each pixel yields a functioning pixel even if a certain portion of the emitters are not functional, although if sufficient non-uniformity exists this may appear visible to a user. Flat panel displays using field emitter arrays with cone electrodes have been produced with 256×256 pixels with each pixel being 0.12 square mm in area. The screen voltage was 250 volts, and a tip to gate voltage was 80 volts. The shortest cathode to cathode distances have been in the range of 100 μm.

Prior attempts at producing ridge emitters in vertical field emission devices have been produced with macro encapsulation. These have only been used to make addressable lines in the shape of a number. The devices are gated diodes with 40 V on the gate and 75 V on the screen.

Vacuum microelectronic devices use considerably lower screen voltages than conventional cathode ray tubes. For example, CRT's screen voltages typically range from 3 to 30 kilovolts while field emitter device screen voltages are less than 500 volts. Special cathodo-luminescent phosphors are needed to effectively operate at these low voltages. Suitable materials have been studied, see A. G. Chakhovakoi et al., 12 J. Vac. Sci. Technol. B 785 (1994). Another consideration with these low voltages is providing a conductive return path for the electrons. Very thin aluminum films used in CRT screens are not penetrated by the low voltage electrons. Indium tin oxide films can provide a transparent conducting layer on the glass to replace the aluminum film at the expense of the loss of some light efficiency.

What is needed is a microencapsulated vertical field emission device. Such a device should have a very small cathode to anode distance and a very small foot print on the substrate to allow a very high density of devices. These device would also have an adequate current at low potentials, and each cathode in an array would be independently addressable. What is further needed is microencapsulated light emitting, field emission diodes. These LEFEDs would be suitable for making high resolution flat panel displays for use in high definition television or high resolution computer screens.

SUMMARY OF THE INVENTION

A field emission device of the present invention has a cathode on the surface of a substrate with an anode vertically above the cathode relative to the substrate. The substrate is preferably a silicon substrate capable of supporting solid state integrated circuits. The minimum cathode—anode separation is very small, less than 15 μm. More preferably the minimum cathode—anode separation is less than 1 μm and most preferably the minimum anode—cathode separation is less than 0.5 μm. Preferred cathodes in the present invention contain sharp edge emitters extending outwardly perpendicular to the surface of the substrate. These sharp edge emitters provide for high electric fields at relatively low voltages. The space between the cathode and the anode is a portion of a sealed cavity at low pressure to allow collisionless electron trajectories between the cathode and the anode.

The field emission components of the present invention can be adapted for the production of light emitting, field emission diodes. In these light emitting diodes, a phosphor is preferably sandwiched between two portions of an anode. The lower portion of the anode is at least partially transparent to relatively low energy electrons, and the upper portion of the anode is at least partially transparent to visible light.

The field emission devices of the present invention have small foot prints on the substrate allowing them to be packed at high densities while being individually addressable. Because the components are manufactured using planar photolithographic techniques, the individual cathode emitters can be integrated onto the substrate along with other solid state components such as transistors. The components can be placed with distances between the centers of nearest cathodes in the order of 5 μm. Arrays of closely packed light emitting, field emission diodes of the present invention are particularly suitable for use in displays with each diode being independently addressable.

The field emission microelectronic components of the present invention are produced using microencapsulation and conventional planar processing with materials compatible with conventional integrated circuit processing facilities and foundries. Layers are deposited using photolithography on a silicon substrate to form a cathode, an anode, a sacrificial layer that defines the space to become the cavity and insulating cover layer. The processing methodology allows for the production of components with very small anode—cathode separations. A small channel is etched in the cover layer to expose a small portion of the sacrificial layer to the exterior of the component. The sacrificial layer is then chemically removed to create a cavity within the device including the space between the anode and the cathode. The small channel is sealed under vacuum conditions preferably by the deposition of sputtered or evaporated material.

The cathodes are preferably produced with sharp edge emitters extending from the cathode vertically toward the anode. A novel process is used to produce these sharp edge emitters while maintaining the very small cathode—anode separations. The sharp edge emitters are produced completely within the planar processing methodology by constructing conformal side walls from a sacrificial material. This conformal side wall provides support for the production of the sharp edge emitters, and are later removed. The conformal side walls can be produced to form a box shaped vacancy. Coating the walls with a conductor will produce a four sided, sharp edge emitter. Other shapes of sharp edge emitters can be produced by varying the shape of the sacrificial layer providing the conformal side wall. The photolithographing process is suitable for the production of a plurality of field emission devices integrated upon a silicon surface at a high packing density.

DETAILED DESCRIPTION OF THE INVENTION

Figure 1A:
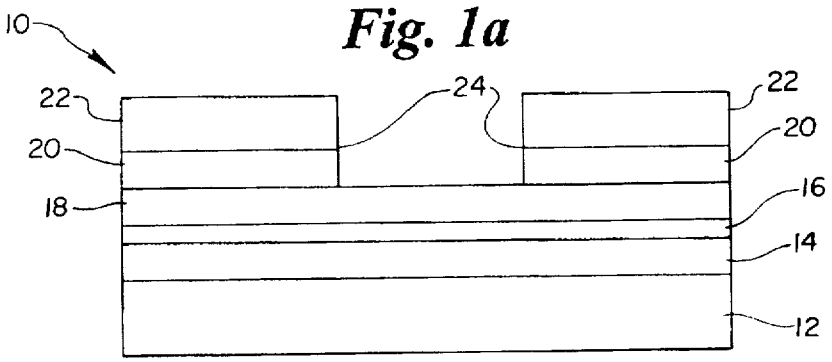
FIGS. 1(*a*)–1(*h*) are sectional, side views of a field emission diode of the present invention at various stages of production.
Figure 1B:
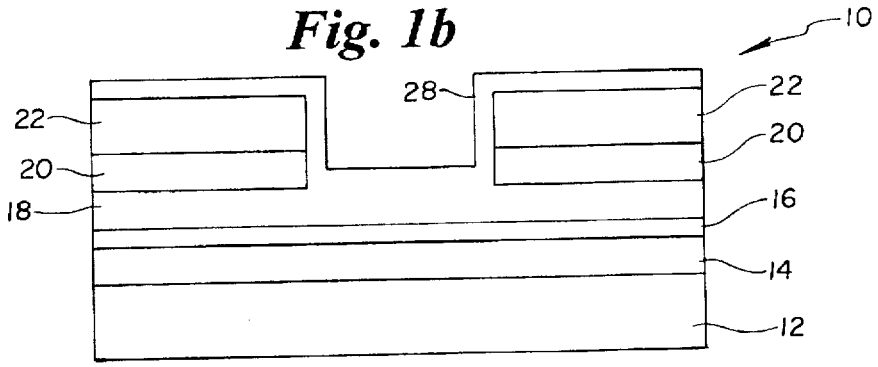
Figure 1C:
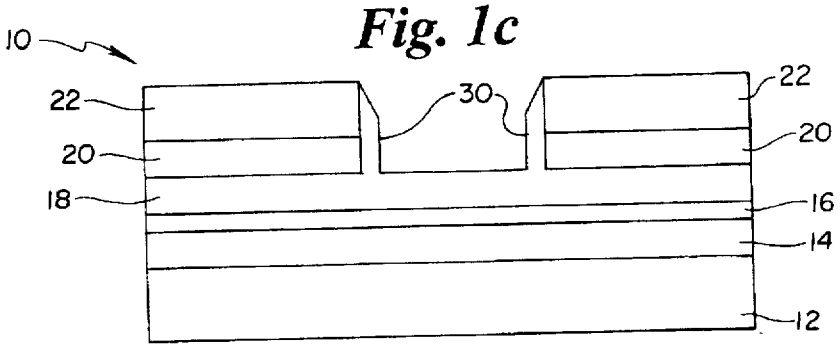
Figure 1D:
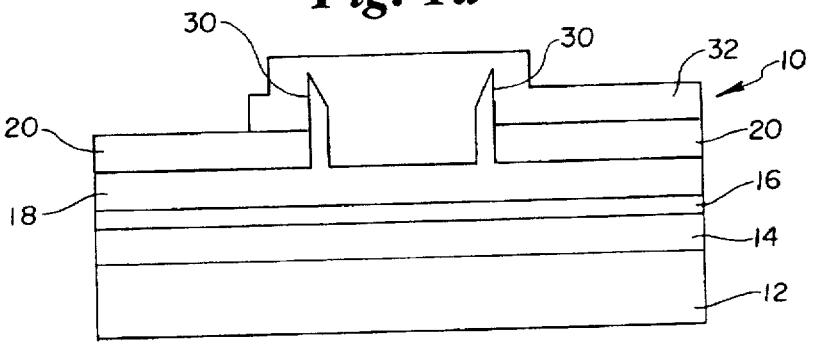
Figure 1E:
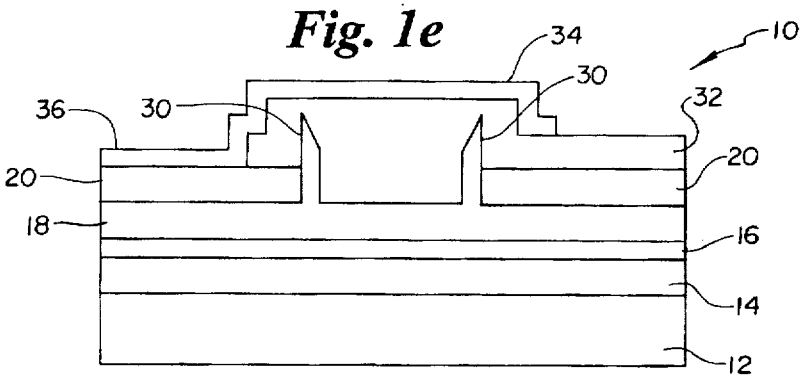
Figure 1F:
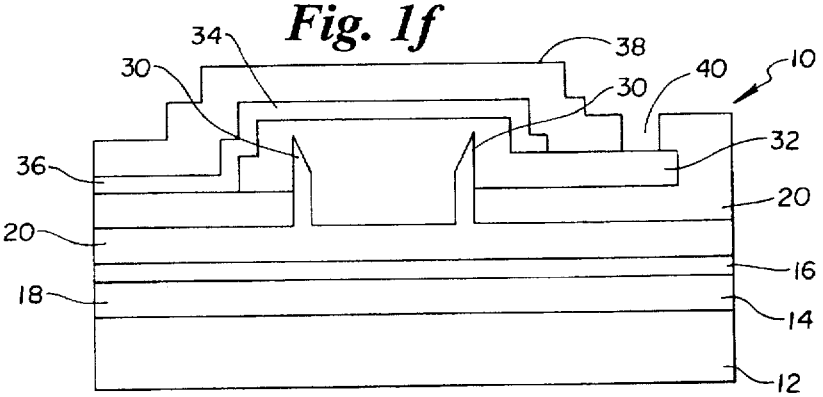
Figure 1G:
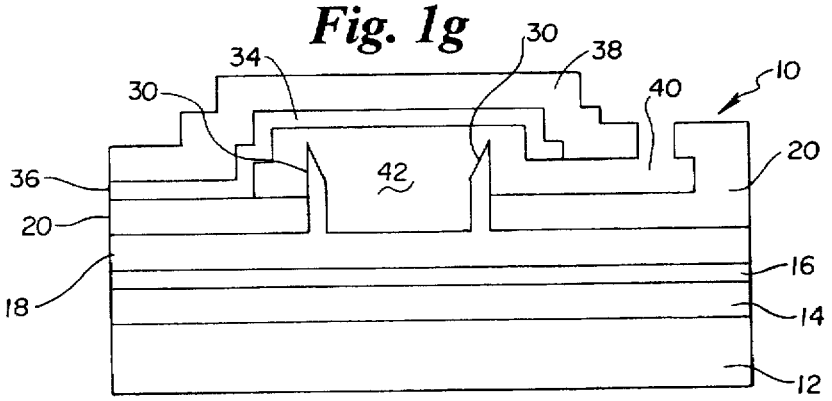
Figure 1H:
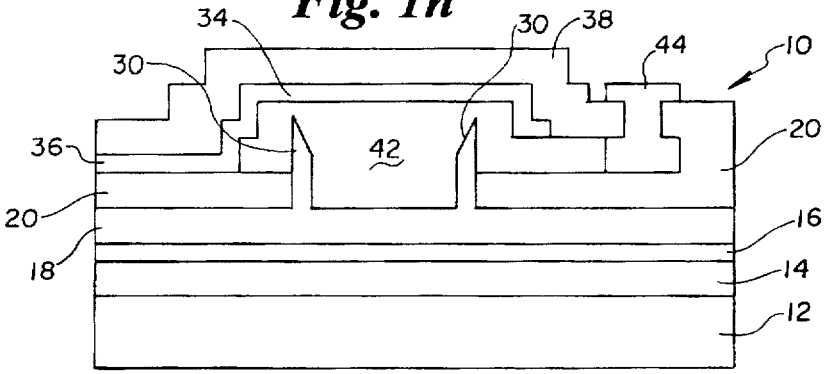

FIG. 1 displays a first embodiment of a field emission diode 10 of the present invention in various stages of preparation. The manufacture of the diode starts with providing a single crystal silicon wafer 12 as a substrate. Then, using well known planar lithography techniques, layers of silicon dioxide, silicon nitride $Si_3N_4$, polycrystalline silicon, phosphosilicate glass (PSG) are sequentially layered and patterned to build up the structure shown in FIG. 1(*a*). The silicon dioxide and silicon nitride are insulators, and the PSG forms a sacrificial layer that is eventually removed (the "lost-wax process). The polycrystalline silicon is n-doped with phosphorous in situ to make it conducting.

More specifically, a 0.5 μm layer of silicon dioxide 14 is first deposited on the top surface of the silicon wafer 12. The silicon dioxide layer 14 serves as an insulator and as a stress reducer at the surface of the silicon wafer 12. Next, an insulating layer 16 of silicon nitride is grown at a thickness of 0.5 μm. Doped polycrystalline silicon is deposited and patterned over a portion of the top surface of the insulating layer 16 to provide an electrical connection path 18 between the polysilicon cathode 30 and the bonding pad integrating the component with the rest of the circuit. Support layers of silicon nitride 20 and PSG 22 are deposited and patterned to form conformal side walls 24 forming a box shaped space 26. This yields the structure shown in FIG. 1(*a*).

A doped polycrystalline silicon layer 28 is next deposited at a thickness of 0.2 μm over the structure to coat the conformal side walls 24, as depicted in FIG. 1(*b*). An anisotropic, reactive ion etch is performed to yield the cathode in FIG. 1(*c*) with sharp ridge emitter 30. The sharp ridge emitter 30 has four connected sides of ridges similar to a box cover.

Having formed the sharp ridge emitters 30, layer 22 of PSG is removed, and 0.3 μm of PSG is deposited and pattered to form a structure 32 that will become the vacuum cavity region. See FIG. 1(*d*). A layer of doped polycrystalline silicon is deposited and patterned to form the anode 34 and the electrical path 36 between the anode 34 and the appropriate bonding pad (not shown). A 1.5 μm layer of low stress silicon nitride is deposited and patterned over the surface to form a cover 38 over PSG structure 32 forming the vacuum cavity region and anode 34. At this point, the PSG is completely encased by either polysilicon and/or silicon nitride, so the PSG is therefore not accessible to chemicals on the outside of the diode 10.

To make the PSG accessible to the outside environment, channels 40 are etched to gain access to the PSG structure 32 at a location away from the cathode 30 and the anode 34. See FIG. 1(*f*). The PSG is chemically etched using a buffered oxide etch with a hydrofluoric acid solution. This removes the PSG without significantly etching the other surfaces. The surfaces of the cathode 30 and anode 34 adsorb a thin layer of hydrogen (not shown) which helps prevent the formation of oxides on the surfaces, thereby keeping the surfaces clean. The removal of the PSG sacrificial layer leaves behind a cavity 42 forming the vacuum region. Finally, a layer of titanium is deposited by electron beam evaporation and patterned to form a seal 44 over hole 40. This final step is performed under a pressure of about $8\times10^{-6}$ Torr to leave the vacuum cavity 42 under low pressure after the cavity 42 is isolated from the atmosphere surrounding the device 10.

Figure 2:
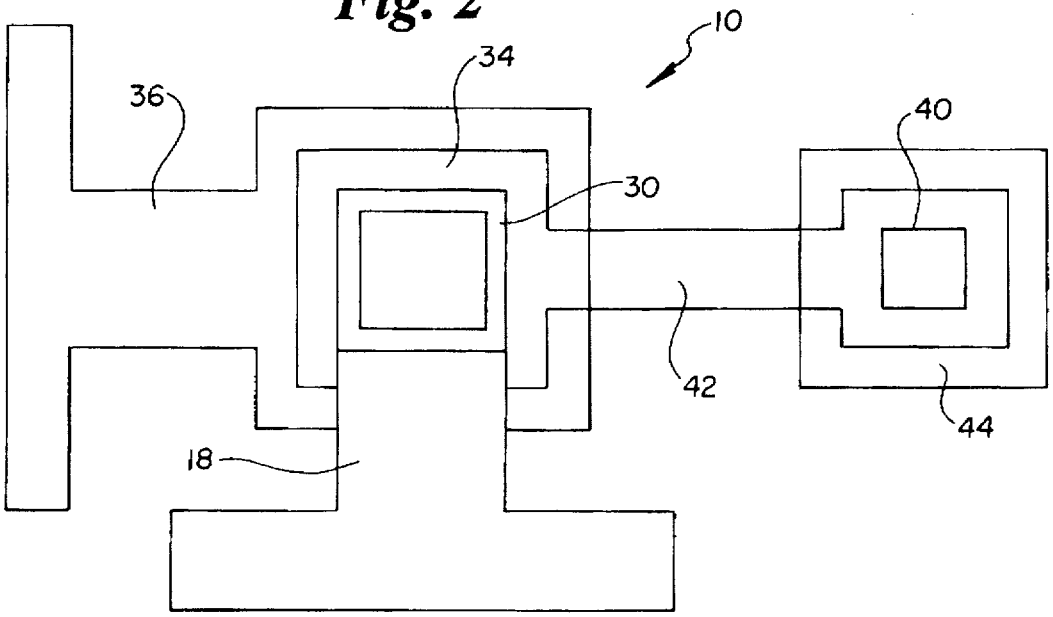
FIG. 2 is a bottom, plan view of the field emission diode of FIG. 1(*h*) with the substrate removed.
Figure 3:
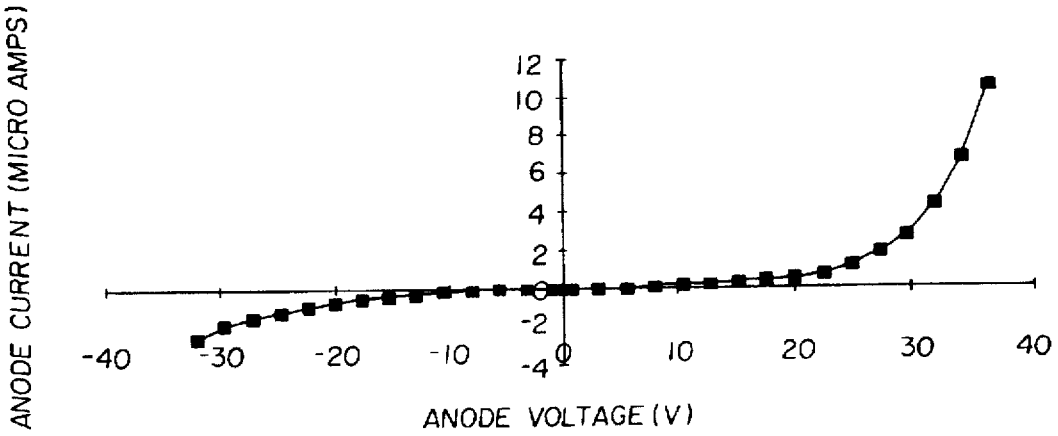
FIG. 3 is a graph depicting the anode current as a function of the anode voltage for the diode of FIGS. 1(*h*) and 2.
Figure 4:
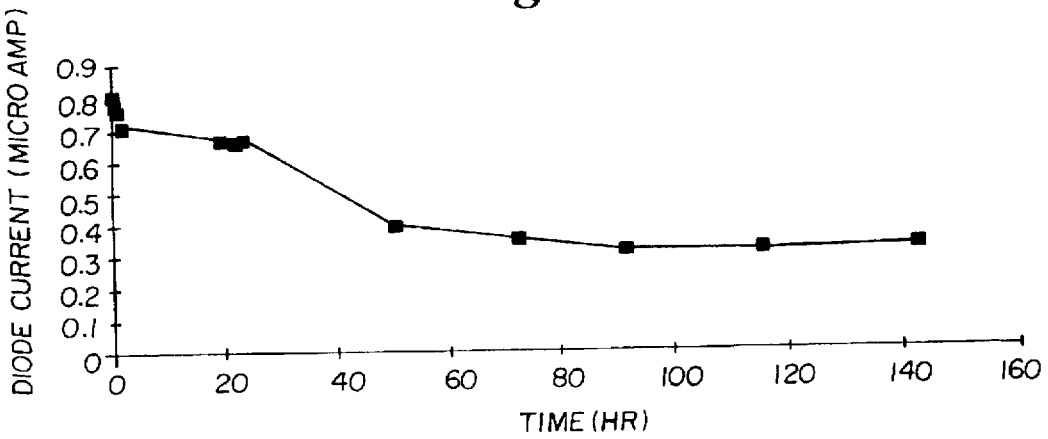
FIG. 4 is a graph depicting the diode current as a function of time for continuous operation for the diode of FIGS. 1(*h*) and 2.

The completed diode 10 of this first embodiment of the present invention is displayed in FIG. 1(*h*) and FIG. 2. The diode 10 has a cathode 30 with an anode 34 vertically spaced from the cathode by about 0.2 μm. A gate is not required in the diode 10 because the small anode 34 to cathode 30 distance yields high enough fields at appropriate potentials. Application of a potential between the cathode 30 and the anode 34 will result in field emission electrons emissions from the ridge emitters 30. The electron trajectory will be approximately vertical going to the closest point on the anode 34. Referring to FIG. 3, the anode 34 current is plotted as a function of anode 34 voltage relative to the cathode 30. The measurements in FIG. 3 were made after 140 hours of continuous operation. FIG. 4 displays the anode 34 current as a function of time with a continuously applied anode to cathode voltage of 19.6 V.

An important consideration for the reliability of a field emission component is the cleanliness of the cathode 30 emitter surface. Generally, significant current reductions occur when proper surface cleaning procedures have not been followed. Diodes 10 within our invention have been produced with greater than 90% yield of functioning devices. This can be attributed to the cleanliness of the cathode 30 surfaces and the efficiency of producing a well sealed vacuum within our novel, yet relatively straightforward production process.

A person of ordinary skill in the art will recognize that other materials can be substituted for those used above in forming the layers. For example, any flat substrate can be used that would adhere the subsequent layers. The use of single crystal silicon permits the field emission component to be integrated with solid state components on the substrate. The silicon dioxide and silicon nitride can be used somewhat interchangeably, but their different crystal structure dictates that one or the other may be more suitable to reduce stress at the interfaces between the layers. Other appropriate insulating layers can be used. The n-doped polycrystalline silicon can be replaced with vapor deposited metals, metal silicides or any other conductor that can be properly deposited in the photolithography process. The PSG can be replaced by photoresist polyamide or any other material that can be selectively dissolved without effecting the other materials significantly.

Figure 5A:
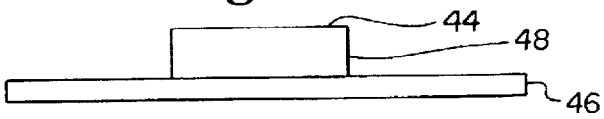
FIGS. 5(*a*)–5(*c*) are sectional, side views depicting various stages of producing a cathode with sharp emitting ridges based on a box like structure providing conformal side walls.
Figure 5B:
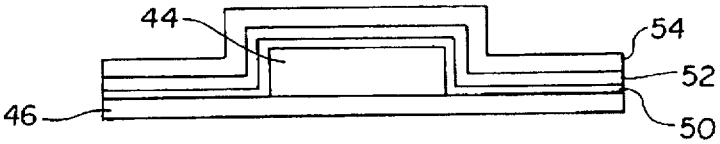
Figure 5C:
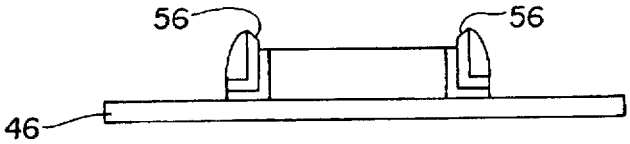

Rather than using a box shaped space 26 to form the conformal side walls 24, a box shaped projection 44 on substrate 46 can be used to form conformal side walls 48, see FIG. 5(*a*). Over the box shaped projection 44, a layer of doped polycrystalline silicon 50 and a layer of gold 52 can be deposited. The surface is covered with a layer 54 of insulating silicon dioxide. An anisotropic etch produces a sharp ridge emitter of gold 56 oriented generally orthogonal to the substrate 44. See FIG. 5(*c*).

Figure 6:
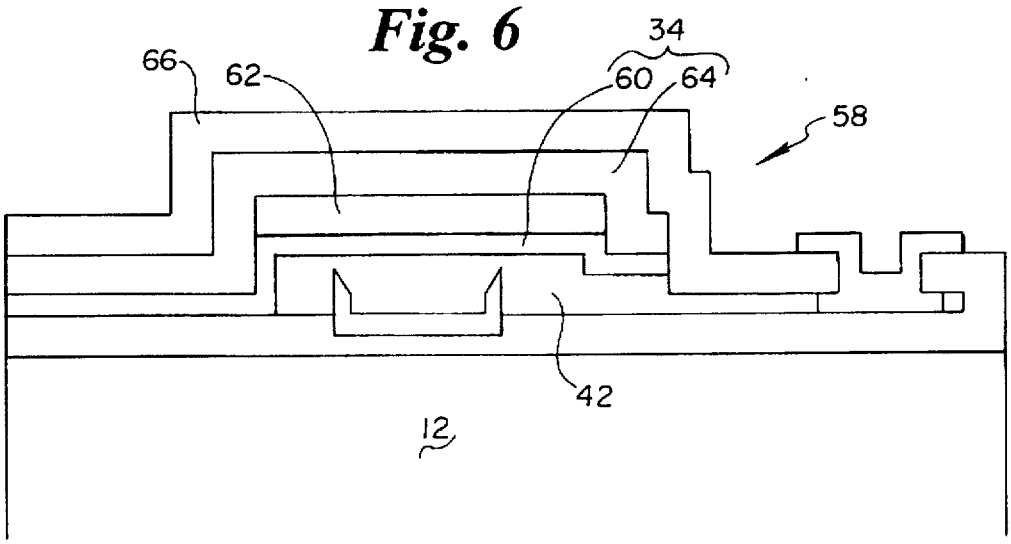
FIG. 6 is a sectional, side view of a light emitting, field emission diode of the present invention.
Figure 7:
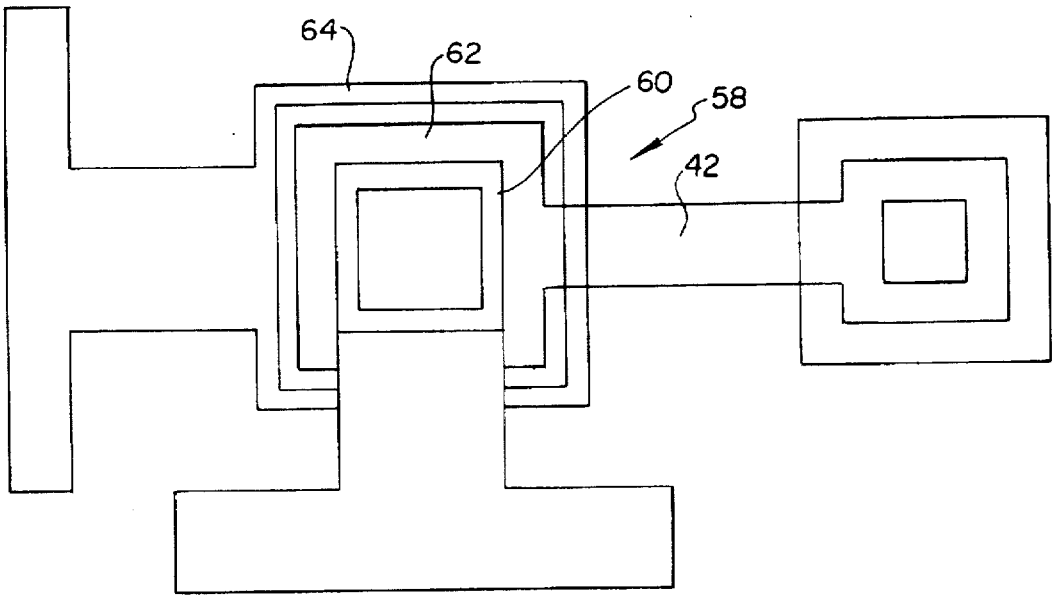
FIG. 7 is a bottom plan view of the light emitting, field emission diode of FIG. 6 with the substrate removed.

FIGS. 6 and 7 display a second embodiment useful for producing a visible signal, i.e. a light emitting, field emission diode (LEFED) 58. The significant differences with the first embodiment begin with the layer forming the top portion of the anode 34. A thin layer 60 of doped polycrystalline silicon is formed over the PSG sacrificial layer 32 which becomes cavity 42. The thinness of the anode layer 60 implies that many of the low energy electrons striking the thin layer 60 will penetrate through to the other side. Experiments in doped GaAs have demonstrated that low energy electrons can penetrate 0.03 μm before scattering. Since much of the scattering results from the impurities doped into the material, similar results should be obtainable with silicon. Therefore, thicknesses on the order of about 0.1 μm or less should be suitable for thin layer 60.

A phosphor 62 is placed through standard photolithography onto the top of the thin layer 60. The phosphor 62 must be luminescent in response to the contact from the relatively low energy electrons. The LEFED 58 will operate at voltages between 10 V–50 V. More preferably, the LEFED will operate between 20 V–35 V. Appropriate phosphors have been found to include ZnO (green), Zn/CdS (red) and ZnS (blue).

On top of the phosphor 62, a layer of indium tin oxide 64 is placed. The indium tin oxide 64 forms a transparent conducting layer that forms a part of the anode 34 since it is electrically in contact with the other portions of the anode 60. The first thin layer 60 is used to isolate the phosphor 62 from the vacuum cavity 42. Many phosphors 62 sputter in response to contact with the electrons from the cathode 30 if not covered, and would contaminate the cathode 30 surface diminishing the performance of the LEFED 58. Finally, the device is covered with a layer of silicon nitride 66 which electrically insulates while allowing the light through since it is transparent.

The above procedures for producing diodes of the present invention can be adapted for the production of other devices, e.g., multiple electrode devices including triodes.

Figure 8:
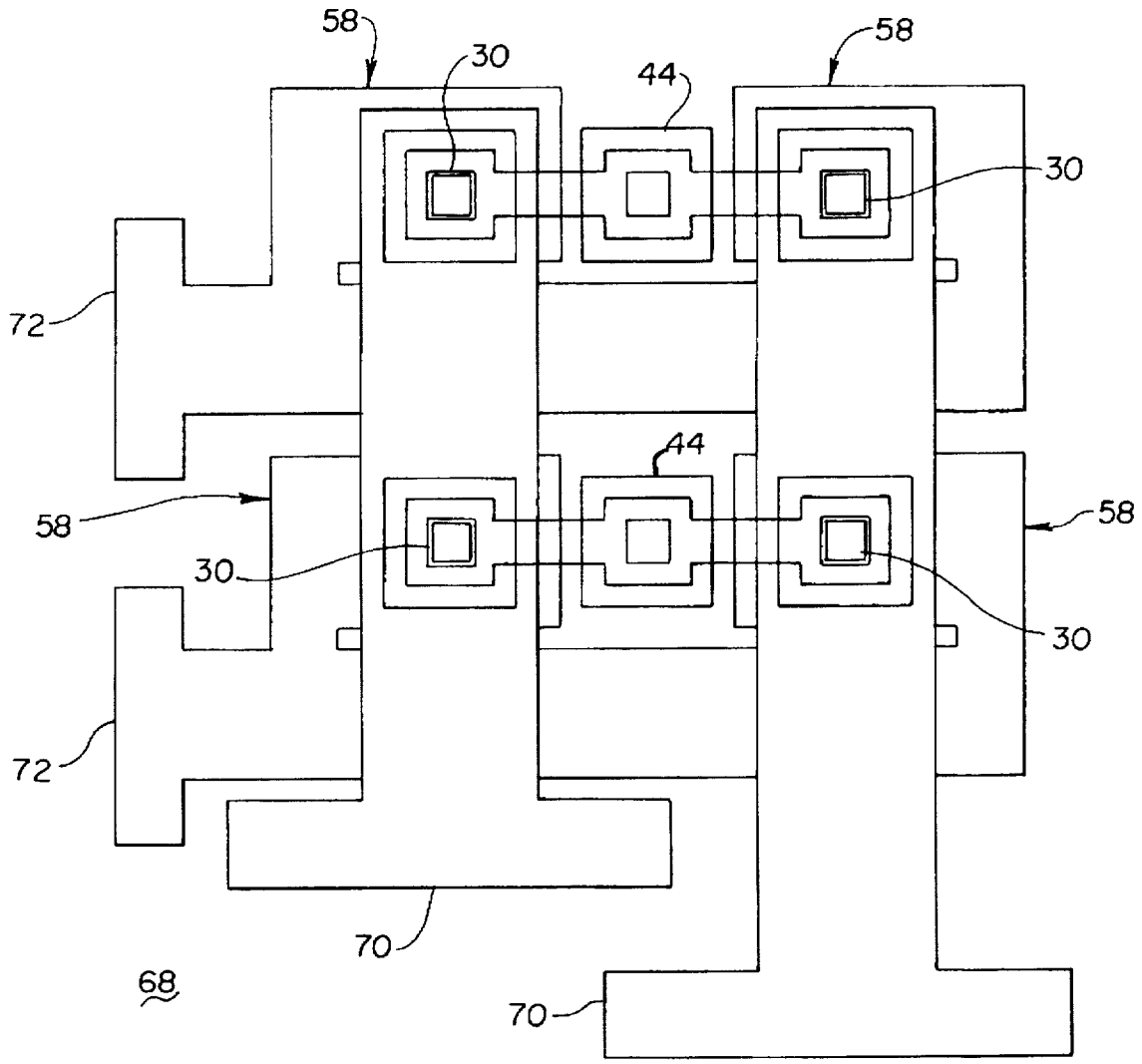
FIG. 8 is a bottom plan view of a plurality of light emitting, field emission diodes of the present invention with the substrate removed.

The planar photolithography techniques are ideally suited to the simultaneous production of multiple devices. FIG. 8 displays four LEFEDs 58 of the present invention integrated onto a surface 68. Two seals 44 are used for the four diodes 58. The cathode ridge emitters 30 are accessed through two cathode base connections 70. The four anodes 34 each with a thin layer 60 of doped polycrystalline silicon and a indium tin oxide layer 64 are electrically connected to two anode base connections 72. The cathode base connections 70 and the anode base connections 72 provide the means to select the relative voltages on the cathode 30 and anode 34. The base connections 70, 72 can be electrically coupled to other integrated components such as transistors (not shown). This provides for the individual addressing of the LEFEDs. Integrated devices incorporating many of these LEFEDs can be produced to make a flat panel display with individually addressable diodes.

A person of ordinary skill in the art will recognize that many different patterns of electrical connections can be lithographed on the integrated surface along with a number of field emission devices and solid state devices. These can be adapted to the particular application.

We claim:

1. A diode field emission vacuum microelectronic component comprising:

a substrate presenting a generally planar surface;

a cathode comprising an emission projection extending outward, generally orthogonal to said substrate surface;

an anode presenting a surface generally facing said emission projections of said cathode, said anode approaching said cathode within a distance less than 15 μm, wherein said anode most closely approaches said cathode in a direction generally orthogonal to said surface of said substrate;

structure defining a surface forming a fully enclosed cavity, said cavity surface spaced apart from said emission projections of said cathode and containing said surface of said anode, wherein said cavity is in isolation from atmosphere surrounding said component.

2. The diode field emission microelectronic component of claim 1 wherein said anode approaches said cathode within a distance less than 5 μm.

3. The diode field emission microelectronic component of claim 1 wherein said substrate is a single crystal silicon wafer.

4. The diode field emission microelectronic component of claim 1 wherein said anode is at least partially transparent to low energy electrons, said component further comprising:

a phosphor capable of being luminescent upon interaction with low energy electrons.

5. The diode field emission vacuum microelectronic component of claim 1 wherein the cathode emission projection is a sharp edge emitter.

6. The diode field emission vacuum microelectronic component of claim 5 wherein the cathode emission projection is formed in closed shape defining an interior space and presenting an opening disposed proximate the anode.

7. The diode field emission vacuum microelectronic component of claim 6 wherein the closed shape of the cathode emission projection is formed having a generally rectangular cross section.

8. The diode field emission vacuum microelectronic component of claim 6 wherein the closed shape of the cathode emission projection is deposited on an interior surface of a conformal wall portion of said conformal wall being formed of a sacrificial material, said sacrificial material being removed subsequent to deposition of the closed shape of the cathode emission projection to expose the cathode emission projection.

9. The diode field emission vacuum microelectronic component of claim 1 wherein the anode has a first portion proximate the cathode and a second spaced apart portion, the second portion being disposed more distant from the cathode than the first portion, and a phosphor layer being disposed between said first and second spaced apart portions.

10. The diode field emission vacuum microelectronic component of claim 9 wherein the anode first portion is at least partially transparent to relatively low energy electrons.

11. The diode field emission vacuum microelectronic component of claim 9 wherein the anode second portion is at least partially transparent to visible light.

12. The diode field emission vacuum microelectronic component of claim 1 wherein a plurality of cathodes are formed integral to the substrate in a closely packed array.

13. The diode field emission vacuum microelectronic component of claim 1 wherein each of the plurality of cathodes is individually addressable.

14. The diode field emission vacuum microelectronic component of claim 1 wherein said cathode is formed of an electrically conducting thin coating conformally deposited on edge surfaces of a sacrificial material operably coupled to the substrate, removal of the sacrificial material forming a cathode sharp edge emitter comprising the emission projection.

15. A field emission vacuum microelectronic component comprising:

a substrate presenting a generally planar surface;

a cathode comprising an emission projection extending outward, generally orthogonal to said substrate surface;

an anode presenting a surface generally facing said emission projections of said cathode, said anode approaching said cathode within a distance less than 0.5 μm, wherein said anode most closely approaches said cathode in a direction generally orthogonal to said surface of said substrate;

structure defining a surface forming a fully enclosed cavity, said cavity surface spaced apart from said emission projections of said cathode and containing said surface of said anode, wherein said cavity is in isolation from atmosphere surrounding said component.

16. A light emitting, field emission diode comprising: a substrate presenting a surface;

a cathode projecting from said surface of said substrate; an anode presenting two surfaces oriented towards said cathode with one of said surfaces being at least partially transparent to visible light and the second of said surfaces being at least partially transparent to relatively low energy electrons;

structure defining a surface forming a fully enclosed cavity, said cavity surface spaced apart from said cathode and containing said surface of said anode, wherein said cavity is in isolation from atmosphere surrounding the device;

a phosphor capable of being luminescent upon interaction with low energy electrons, said phosphor being located between said two surfaces of said anode oriented towards said cathode.

17. A solid state electronic device comprising:

a plurality of diode field emission microelectronic components operably integrated into a surface of a silicon substrate such that each emission cathode is individually addressable, wherein each field emission microelectronic component is comprised of a cathode being a sharp edge emitter and having a cathode emission projection formed in a closed shape defining an interior space and presenting an opening disposed proximate the anode, and having a center relative to its position on said surface of said substrate, an anode and a surface defining a cavity in isolation from atmosphere surrounding said component and wherein said center of each cathode of said field emission microelectronic component is spaced no more than 10 μm from said center of a nearest of other said cathodes along said surface of said substrate.

18. A flat-panel display comprising:

a plurality of independently addressable light emitting, Held emission microelectronic diodes operably integrated into a surface of a single silicon substrate wherein each field emission diode is comprised of a cathode being a sharp edge emitter and having a cathode emission projection formed in a closed shape defining an interior space and presenting an opening disposed proximate the anode, and having a center relative to its position on said surface of said substrate, an anode and a surface defining a cavity in isolation from atmosphere surrounding said diode and wherein said center of each cathode of said field emission microelectronic component is spaced no more than 10 μm from said center of a nearest of other said cathodes along said surface of said substrate.

* * * * *